United States Patent [19]

Hattori et al.

[11] 4,315,787

[45] Feb. 16, 1982

[54] WATER-IN-OIL EMULSION EXPLOSIVE COMPOSITION

[75] Inventors: Katsuhide Hattori; Yoshiaki Fukatsu; Masao Takahashi, all of Chita, Japan

[73] Assignee: Nippon Oil and Fats Co. Ltd., Tokyo, Japan

[21] Appl. No.: 135,231

[22] Filed: Mar. 31, 1980

[30] Foreign Application Priority Data

Apr. 9, 1979 [JP] Japan ..... 54/42005

[51] Int. Cl.[3] ..... C06B 45/00

[52] U.S. Cl. ..... 149/2; 149/60; 149/61

[58] Field of Search ..... 149/2, 2 F, 60, 61

[56] References Cited

U.S. PATENT DOCUMENTS

| | | | |
|---|---|---|---|
| 3,674,578 | 7/1972 | Cattermore et al. | 149/2 |
| 3,995,673 | 12/1976 | Grigaitis et al. | 149/2 |
| 4,008,108 | 2/1977 | Chrisp | 149/2 F |
| 4,110,134 | 8/1978 | Wade | 149/2 |
| 4,111,727 | 9/1978 | Clay | 149/2 |
| 4,248,644 | 2/1981 | Healy | 149/2 |

*Primary Examiner*—Edward A. Miller

*Attorney, Agent, or Firm*—Stevens, Davis, Miller & Mosher

[57] ABSTRACT

A water-in-oil emulsion explosive composition consisting of ammonium nitrate or a mixture of ammonium nitrate and the other inorganic oxidizer salts, water, oil and/or wax, at least one emulsifier of the group consisting of potassium octadecylsulfonate and sodium N-methyl-N-alkyl(beef tallow)-taurate and at least one of hollow microspheres and bubbles generated from a chemical foaming agent is excellent in the emulsion stability in storage, detonability at low temperature, explosion reactivity and sympathetic detonability.

7 Claims, No Drawings

WATER-IN-OIL EMULSION EXPLOSIVE COMPOSITION

BACKGROUND OF THE INVENTION (1) Field of the Invention

The present invention relates to water-in-oil (W/O) emulsion explosive compositions having excellent stability in storage, detonability at low temperature, explosion reactivity and sympathetic detonability, which is obtained by the use of at least one of specifically limited sulfonates as an emulsifier.

(2) Description of the Prior Art

Heretofore, the improvement of explosion reactivity (usually represented by the explosion velocity) in general explosives has been effected by (1) selecting the components of the explosive composition and (2) varying the mixed state between each component of the explosive composition. The above described former method (1) comprises selecting substances having a high reaction velocity, selecting substances which generate a large heat energy upon the reaction, that is, have a high explosion heat, and the like, as a means for enhancing the reactivity of explosive composition. The above described latter method (2) comprises contacting an oxidizer with a fuel in fine particle form, that is, increasing the contact area or dissolving these substances with each other through water to increase the contact area, as a means for enhancing the reactivity of mixed phase.

When a water soluble substance and a water insoluble substance are contained in a slurry explosive, it is very difficult to contact both the substances in a dissolution state through water, so that it is necessary to form a mixed phase wherein an aqueous solution of a water soluble substance and a water insoluble substance are contacted with each other in the state where both the substances are formed into particle state to increase the contact area.

Almost all of conventional slurry explosive compositions have been oil-in-water (referred to as O/W hereinafter) emulsion explosive compositions, in which water of the major component envelops water insoluble substances or water soluble substances which can not be fully dissolved in water and remain in water. The major part of the water soluble substances in the O/W emulsion explosive compositions are oxidizers, for example, inorganic oxidizer salts, such as ammonium nitrate and the like, and the major part of the water insoluble substances are fuels or sensitizers which act as a fuel together, for example, aluminum, nitromethane and the like.

In general, in slurry explosive compositions, when the components are classified into water insoluble substances (referred to as "O") and water soluble substances (referred to as "W"), the compounding ratio by weight of O/W is generally not more than 25/75. Thus, when it is considered that the dispersed particle size in O/W emulsion and W/O emulsion is equal, the contact area of O and W is larger in W/O emulsion, wherein O which is smaller in the amount envelops W which is larger in the amount, than in O/W emulsion. Accordingly, it is expected that the explosion reactivity is improved in W/O emulsion. As the results, the explosive wherein smoke is few and the after-detonation fume is good, can be obtained.

Thus, in view of increase of the contact area, a variety of W/O emulsion explosive compositions have been disclosed instead of the prior O/W emulsion explosive compositions in U.S. Pat. Nos. 3,161,551; 3,164,503; 3,212,945; 3,356,547; 3,442,727; 3,447,978; 3,617,406; 3,674,578; 3,765,964; 3,770,522 and 4,008,108. In these W/O emulsion explosive compositions, the quality of W/O emulsion explosive compositions is greatly influenced by the kind of emulsifier necessary for forming W/O emulsion. In the W/O emulsion explosive compositions described in the above described United States Patent specifications, emulsifiers shown in the following Table 1 are used.

TABLE 1

| U.S. Pat. No. | Emulsifier |
|---|---|
| 3,161,551 | (1) 4,4-bis(hydroxymethyl)-1-pentadecyl-2-oxazoline |
| | (2) 4-methyl-4-hydroxymethyl-1-heptadecyl-2-oxazoline |
| 3,212,945 | (1) glycerine monostearate |
| | (2) alkyl ester of abietic acid and metal salt thereof |
| | (3) polyglycol ether |
| | (4) addition product of higher fatty acid amine to ethylene oxide |
| | (5) polyvinyl alcohol |
| | (6) ester of higher fatty acid with higher alcohol |
| | (7) salt of higher fatty acid |
| 3,442,727 | alkyl phosphoric acid ester |
| 3,164,503 | |
| 3,447,978 | sorbitan fatty acid ester |
| 3,765,964 | |
| 3,356,547 | (1) calcium stearate |
| | (2) zinc stearate |
| 3,770,522 | (1) ammonium stearate |
| | (2) alkali metal salt of stearic acid |
| 4,008,108 | sodium stearate |
| 3,617,406 | (1) polyoxyethylene alkyl ester |
| | (2) polyoxyethylene alcohol |
| | (3) polyoxyethylene alkyl ether |
| 3,674,578 | (1) metal salt of oleic acid |
| | (2) sorbitan fatty acid ester |
| | (3) ethylene oxide condensate of fatty acid |
| | (4) dodecylbenzenesulfonic acid |
| | (5) tall oil amide |

It is commonly known that the above described various emulsifiers are used, but almost all W/O emulsion explosive compositions using an emulsifier other than sorbitan fatty acid ester are poor in the emulsion stability in storage, and are insufficient in the explosion reactivity and in the detonability at low temperature. W/O emulsion explosive compositions using sorbitan fatty acid ester are good in the emulsion stability in storage, the explosion reactivity and the like. However, commercially available sorbitan fatty acid ester is not always composed of single component and often contains its isomers, polycondensate and the like. Therefore, it has been difficult to produce W/O emulsion explosive compositions having always stable performance by the use of commercially available sorbitan fatty acid ester.

SUMMARY OF THE INVENTION

The inventors have made various investigations for a long period of time by taking the above described problems into consideration and found out that a substance, which has never hitherto been considered as an emulsifier for W/O emulsion explosive composition, can form a mixture of an aqueous solution of inorganic oxidizer salts, such as ammonium nitrate and the like, (an aqueous solution of oxidizer salt) and an oil and/or wax into W/O emulsion, and further found out that the W/O emulsion explosive composition obtained by the use of the emulsifier has excellent emulsion stability in storage, explosion reactivity, detonability at low temperature and sympathetic detonability. As the result, the present invention has been accomplished.

That is, the present invention consists in a W/O emulsion explosive composition consisting of ammonium nitrate or a mixture of ammoniun nitrate and the other inorganic oxidizer salts (referred to as "inorganic oxidizer salts, such as ammonium nitrate and the like" hereinafter), (b) water, (c) an oil and/or wax, (d) an emulsifier of at least one of the group consisting of potassium octadecylsulfonate and sodium N-methyl-N-alkyl(beeftallow)-taurate, and (e) at least one of hollow microspheres and bubbles generated from a chemical foaming agent.

DESCRIPTION OF THE PREFERRED EMBODIMENT

The W/O emulsion explosive composition according to the present invention is produced by a method, wherein (A) inorganic oxidizer salts, such as ammonium nitrate and the like, are wholly or partly dissolved in water at 55°-90° C. to prepare an aqueous solution of oxidizer salt, (B) an oil and/or wax is mixed with the above described emulsifier of specifically limited sulfonates at 55°-90° C. to prepare a homogeneous liquid mixture of the oil and/or wax and the emulsifier, (C) the aqueous solution of oxidizer salt is mixed with the homogeneous liquid mixture of oil and/or wax and emulsifier at 55°-90° C. under stirring to prepare an emulsion composition, (D) the emulsion composition is mixed with remaining inorganic oxidizer salts, such as ammonium nitrate and the like, in the case where the inorganic oxidizer salts have been partly added to water in the above described step (A), and (E) at least one of hollow microspheres and a chemical foaming agent is added to the emulsion composition, whereby the density of the emulsion composition is controlled by the presence of at least one of the hollow microspheres and bubbles generated from the chemical foaming agent.

Components which can be used in the present invention are as follows. Namely, as the other inorganic oxidizer salts used together with ammonium nitrate, use is made of nitrates, such as sodium nitrate, calcium nitrate and the like; chlorates, such as sodium chlorate and the like; perchlorates, such as sodium perchlorate and like. As the oil and/or wax, use is made of oils, such as light oil, heavy oil, other hydrocarbon oil and the like, and waxes, such as paraffin wax, petrolatum wax, microcrystalline wax and the like. These oils and/or waxes may be used in various mixing ratios depending upon the consistency of the aimed explosive compositions. As the sulfonates, there can be used aliphatic sulfonates and aromatic sulfonates. For example, use may be made of potassium octadecylsulfonate, sodium dodecylbenzenesulfonate, ammonium dodecylbenzenesulfonate, calcium dodecylbenzenesulfonate, sodium N-methyl-N-alkyl (beef tallow)-taurate and the like. Further, sulfates, such as sodium sperm alcohol sulfate and the like, can be used. As the hollow microspheres and/or chemical foaming agent (hereinafter referred to as density controlling agent), the following hollow microspheres and chemical foaming agents can be used. The hollow microspheres include glass hollow microspheres, synthetic resin hollow microspheres, silica hollow microspheres, shirasu hollow microspheres (shirasu is a kind of volcanic ashes) and the like. It is not necessary that these hollow microspheres are fine and expensive hollow microspheres, but coarse hollow microspheres having an average particle size of about 500 μm can be used. The chemical foaming agents include inorganic foaming agents, for example, a mixture of alkali metal borohydride or sodium nitrite with urea, and organic foaming agents, such as N,N'-dinitrosopentamethylenetetramine, azodicarbonamide, azobisisobutyronitrile and the like.

The compounding recipe of these components for the W/O emulsion explosive composition of the present invention should be determined by taking oxygen balance, detonability, strength, consistency and productivity into consideration. In general, 50-90% (% means by weight) of inorganic oxidizer salts, such as ammonium nitrate and the like, 5-20% of water, 1-7% of an oil and/or wax, 1-5% of an emulsifier, 1-10% of hollow microsphere and 0.1-2% of a chemical foaming agent are compounded.

The present invention will be explained in more detail referring to examples and comparative examples. In the examples, "parts" and "%" mean by weight.

In evaluation of W/O emulsion explosive compositions produced in the examples, the emulsion stability in storage was determined by the temperature cycle test, the detonability at low temperature and explosion reactivity were determined by the initiation test and the detonation velocity at that time and the sympathetic detonability was determined by the air gap test on sand.

The temperature cycle test was carried out in the following manner. A W/O emulsion explosive composition sample was kept at 0° C. for 14 hours and then kept at 40° C. for 7 hours, which was referred to as one cycle. This was repeated and the cycle number when the W/O emulsion was broken, was determined. However, when the W/O emulsion was hardly broken, repeating of the temperature cycle was stopped and the emulsion state of the W/O explosive composition sample was observed.

The initiation test and the measurement of detonation velocity were carried out in the following manner. A sample emulsion explosive composition was charged into a polyethylene film tube having a diameter of 25 mm and a length of 200 mm and the tube end was sealed to obtain a cartridge. The cartridge was placed in a thermostat so as to adjust the cartridge to a test temperature and then taken out from the thermostat. A probe was inserted into the cartridge and the explosive sample in the cartridge was initiated by a No. 6 electric blasting cap on sand under an unconfined state. The detonation velocity of the explosive sample was measured by means of a digital counter.

The sympathetic detonability was expressed by a value of air gap test, which was determined as follows. The temperature of the sample was adjusted at +50° C. and then an initiator cartridge and a receptor cartridge into each of which No. 6 electric blasting cap was inserted, were put on sand at interval of various times as large as the cartridge diameter and the initiator cartridge was initiated to detonate the receptor cartridge. The distance between the initiator cartridge and the receptor cartridge was shown by the time number of the diameter of the sample cartridge as the value of air gap test.

COMPARATIVE EXAMPLE 1

To 113 parts of water were added 741 parts of ammonium nitrate, 24 parts of sodium nitrate and 24 parts of calcium nitrate, and the resulting mixture was heated at about 80° C. to dissolve the nitrates in water and to obtain an aqueous solution of the oxidizer salts. While, 17 parts of butyl stearate as an emulsifier was added to 36 parts of No. 2 light oil, and the resulting mixture was heated at about 80° C. to obtain a homogeneous liquid mixture of the emulsifier and the oil. The aqueous solution of the oxidizer salts was gradually added to the homogeneous liquid mixture of the emulsifier and the oil, while agitating at a rate of about 300 rpm by means of a commonly used propeller blade-type agitator. After completion of the addition, the resulting mixture was further agitated at a rate of 1,500 rpm to prepare an emulsion composition kept at about 80° C. Successively, the emulsion composition at about 80° C. was kneaded together with 45 parts of glass hollow microspheres as a density controlling agent to produce a W/O emulsion explosive composition.

The resulting W/O emulsion explosive composition was subjected to the temperature cycle test and the initiation test. The obtained results are shown in Table 2 together with compounding recipe.

COMPARATIVE EXAMPLES 2–9

W/O emulsion explosive compositions having a compounding recipe shown in Table 2 were produced in the same manner as described in Comparative example 1. In this case, only in Comparative examples 3, 4 and 8, emulsion was formed. Accordingly, only the W/O emulsion explosive compositions of Comparative examples 3, 4 and 8 were subjected to the temperature cycle test and the initiation test. In Comparative examples 2, 5, 6, 7 and 9, emulsion was not formed, and therefore glass hollow microspheres were not used (the amount of hollow microspheres described in Table 2 is an amount which would be used in the emulsifying stage).

TABLE 2(a)

| | | | Comparative example | | | | | | | | |
|---|---|---|---|---|---|---|---|---|---|---|---|
| | | | 1 | 2 | 3 | 4 | 5 | 6 | 7 | 8 | 9 |
| Compounding recipe (%) | Aqueous solution of oxidizer salt | ammonium nitrate | 74.1 | 74.1 | 74.1 | 74.1 | 74.1 | 74.1 | 74.1 | 74.1 | 74.1 |
| | | sodium nitrate | 2.4 | 2.4 | 2.4 | 2.4 | 2.4 | 2.4 | 2.4 | 2.4 | 2.4 |
| | | calcium nitrate | 2.4 | 2.4 | 2.4 | 2.4 | 2.3 | 2.4 | 2.4 | 2.4 | 2.4 |
| | | water | 11.3 | 11.3 | 11.3 | 11.3 | 11.3 | 11.3 | 11.3 | 11.3 | 11.3 |
| | Emulsifier | butyl stearate | 1.7 | — | — | — | — | — | — | — | — |
| | | potassium stearate | — | 1.7 | — | — | — | — | — | — | — |
| | | polyoxyethylene-octadecylamine | — | — | 1.7 | — | — | — | — | — | — |
| | | alkyl(coconut oil) phosphoric acid ester | — | — | — | 1.7 | — | — | — | — | — |
| | | polyoxyethylene monooleate | — | — | — | — | 1.7 | — | — | — | — |
| | | polyoxyethylene cetyl ether | — | — | — | — | — | 1.7 | — | — | — |
| | | dodecylbenzene-sulfonic acid | — | — | — | — | — | — | 1.7 | — | — |
| | | alkyl(coconut oil)alkylolamide | — | — | — | — | — | — | — | 1.7 | — |
| | | polyoxyethylene alcohol | — | — | — | — | — | — | — | — | 1.7 |

TABLE 2(b)

| | | | Comparative example | | | | | | | | |
|---|---|---|---|---|---|---|---|---|---|---|---|
| | | | 1 | 2 | 3 | 4 | 5 | 6 | 7 | 8 | 9 |
| Compounding recipe (%) | Oil or wax | No. 2 light oil | 3.6 | 3.6 | 3.6 | 3.6 | 3.6 | 3.6 | 3.6 | 3.6 | 3.6 |
| | Density controlling agent | glass hollow microspheres | 4.5 | 4.5 | 4.5 | 4.5 | 4.5 | 4.5 | 4.5 | 4.5 | 4.5 |
| Evaluation | Emulsification(1) | | O | X | O | O | X | X | X | O | X |
| | Emulsion(2) stability in storage | Repeated number of temperature cycles | 1 | — | 1 | 2 | — | — | — | 1 | — |
| | | emulsion state | X | — | X | X | — | — | — | X | — |
| | Detona-(3) bility at low temperture (after temperature cycles) | temperature (°C.) | 20 | — | 20 | 20 | — | — | — | 20 | — |
| | | detonation | X | — | X | X | — | — | — | X | — |

Note:
(1)In the item of emulsification, the mark "O" means the emulsion was formed, and the mark "X" means the emulsion was not formed.
(2)In the item of emulsion stability in storage, the numeral in the upper line shows the repeated number of temperature cycles, and the mark "X" in the lower line shows that the emulsion is broken after repeating temperature cycles shown by the numeral.
(3)In the item of detonability at low temperature, the upper line shows the initiation test temperature, and the mark "X" in the lower line means that the explosive composition did not detonate at the temperature.

EXAMPLE 1

To 113 parts of water were added 741 parts of ammonium nitrate, 24 parts of sodium nitrate and 24 parts of calcium nitrate, and the resulting mixture was heated at about 80° C. to dissolve the nitrates and to prepare an aqueous solution of the oxidizer salts. While, 17 parts of sodium dodecylbenzenesulfonate was added to 36 parts of No. 2 light oil, and the resulting mixture was heated at about 80° C. to obtain a homogeneous liquid mixture of the emulsifier and the oil. The aqueous solution of the oxidizer salts was gradually added to the homogeneous liquid mixture of the emulsifier and the oil, while agitating by means of a propeller blade-type agitator at a rate of about 300 rpm. After completion of the addition, the resulting mixture was further agitated at a rate of 1,500 rpm to produce an emulsion composition kept at about 80° C. Successively, the emulsion composition kept at about 80° C. was kneaded together with 45 parts of glass hollow microspheres as a density controlling agent to produce a W/O emulsion explosive composition. The resulting W/O emulsion explosive composition was subjected to the temperature cycle test, the initiation test, the measurement of detonation velocity, and the air gap test on sand. The obtained results are shown in Table 3 together with the compounding recipe.

EXAMPLES 2-10

W/O emulsion explosive compositions having a compounding recipe shown in Table 3 were produced in the same manner as described in Example 1. The resulting W/O emulsion explosive compositions were subjected to the temperature cycle test, the initiation test, the measurement of detonation velocity, and the air gap test on sand. The obtained results are shown in Table 3. However, in Example 4, after a chemical foaming agent (dinitrosopentamethylenetetramine) as a density controlling agent was added to an emulsion composition, the resulting mixture was heated in a thermostat kept at about 50° C. for 2 hours to decompose and foam the foaming agent, whereby the density of the emulsion composition was lowered.

TABLE 3(a)

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| Compounding recipe (%) | Aqueous solution of oxidizer salt | ammonium nitrate | 74.1 | 74.1 | 74.1 | 83.7 | 60.5 | 60.5 | 60.5 | 60.5 | 60.5 | 75.7 |
| | | potassium nitrate | 2.4 | 2.4 | 2.4 | — | 15.1 | 15.1 | 15.1 | 15.1 | 15.1 | 2.4 |
| | | calcium nitrate | 2.4 | 2.4 | 2.4 | — | — | — | — | — | — | 2.4 |
| | | water | 11.3 | 11.3 | 11.3 | 10.3 | 11.2 | 11.2 | 11.2 | 11.2 | 11.2 | 11.5 |
| | Emulsifier | sodium dodecylbenzenesulfonate | 1.7 | 1.7 | 1.7 | 1.8 | — | — | — | — | — | 1.7 |
| | | sodium N-methyl-N-alkyl (beef tallow)-taurate | — | — | — | — | 2.0 | — | — | — | — | — |
| | | sodium sperm alcohol sulfate | — | — | — | — | — | 2.0 | — | — | — | — |
| | | potassium octadecylsulfonate | — | — | — | — | — | — | 2.0 | — | — | — |
| | | ammonium dodecylbenzenesulfonate | — | — | — | — | — | — | — | 2.0 | — | — |
| | | calcium dodecylbenzenesulfonate | — | — | — | — | — | — | — | — | 2.0 | — |
| | Oil or wax | No. 2 light oil | 3.6 | 3.6 | — | 1.6 | 3.8 | 3.8 | 3.8 | 3.8 | 3.8 | 3.6 |
| | | unpurified microcrystalline wax | — | — | 3.6 | 1.6 | — | — | — | — | — | — |

TABLE 3(b)

| | | | | Example | | | | | | | | | |
|---|---|---|---|---|---|---|---|---|---|---|---|---|---|
| | | | | 1 | 2 | 3 | 4 | 5 | 6 | 7 | 8 | 9 | 10 |
| Compounding recipe (%) | Density controlling agent | Hollow microspheres | glass | 4.5 | — | — | — | — | — | — | — | — | 2.7 |
| | | | synthetic[1] resin | — | 4.5 | — | — | — | — | — | — | — | — |
| | | | shirasu | — | — | 4.5 | — | 7.4 | 7.4 | 7.4 | 7.4 | 7.4 | — |
| | | Chemical foaming agent[2] | | — | — | — | 1.0 | — | — | — | — | — | — |
| Evaluation | Emulsification[3] | | O | O | O | O | O | O | O | O | O | O | |
| | Emulsion[4] stability in storage | Repeated number of temperature cycles | | 30 | 30 | 30 | 30 | 20 | 20 | 20 | 20 | 20 | 30 |
| | | Emulsion state | | O | O | O | O | O | O | O | O | O | O |
| | Performance after temperature cycles | Detonability low at temperature | temperature (°C.) | −20 | −20 | −20 | −20 | −20 | −20 | −20 | −20 | −20 | −10 |
| | | | detonation | O | O | O | O | O | O | O | O | O | O |
| | | Detonation velocity (m/sec)[6] | | 4,520 | 4,180 | 3,880 | 4,210 | 3,760 | 3,680 | 3,710 | 3,750 | 3,810 | 4,310 |
| | | Value of air gap test[7] | | 2.0 | 2.0 | 2.0 | 2.5 | 2.5 | 2.5 | 2.5 | 2.5 | 2.5 | 1.5 |
| | Density (g/cc) | | | 1.18 | 1.17 | 1.17 | 1.08 | 1.05 | 1.07 | 1.06 | 1.07 | 1.05 | 1.26 |

Note:
[1]The synthetic resin hollow microspheres are phenolic resin hollow microspheres.
[2]As the chemical foaming agent, dinitrosopentamethylenetetramine was used.
[3]In the item of emulsification, the mark "O" means that emulsion was formed, and the mark "X" means that emulsion was not formed.
[4]In the item of emulsion stability in storage, the numeral in the upper line shows the repeated number of temperature cycles, and the mark "O" in the lower line means that good emulsion state is still maintained after repeating temperature cycles shown by the numeral.
[5]In the item of detonability at low temperature, the upper line shows the initiation test temperature, and the mark "O" in the lower line means that the explosive composition detonated at the temperature.
[6]In the item of detonation velocity, the numeral shows the detonation velocity at the above described initiation test.
[7]Both the initiator cartridge and the receptor cartridge used in the air gap test on sand have a diameter of 30 mm.

The results of the above described comparative examples and examples shown in the above Tables 2 and 3 will be explained in detail. In Comparative examples 2, 5, 6, 7 and 9, W/O emulsion explosive compositions were produced by the use of potassium stearate, polyoxyethylene monooleate, polyoxyethylene cetyl ether, dodecylbenzenesulfonic acid and polyoxyethylene alcohol as an emulsifier, respectively. However, emulsion was not be able to be formed. In Comparative examples 1, 3, 4 and 8, W/O emulsion explosive compositions were produced by the use of butyl stearate, polyoxyethyleneoctadecylamine, alkyl(coconut oil) phosphoric acid ester and alkyl(coconut oil)alkylolamide as an emulsifier respectively, and emulsion was able to be formed. However, when the above described temperature cycle test of the explosive compositions of Comparative examples 1, 3, 4 and 8 was carried out, emulsion was broken after one time, one time, two times and one time of temperature cycles respectively, and the broken emulsion explosive compositions were not able to be detonated at 20° C. by a No. 6 blasting cap.

In Example 1, a W/O emulsion explosive composition was produced by the use of sodium dodecylbenzenesulfonate and a good emulsion was formed. After as large as 30 times of temperature cycles, the emulsion explosive composition maintained its good emulsified state without any change, and was able to be detonated at −20° C. by a No. 6 blasting cap, and had a high detonation velocity of 4,520 m/sec.

In Examples 2, 3 and 4, W/O emulsion explosive compositions were produced by the use of the same emulsifier as that used in Example 1 and by the use of resin hollow microspheres, shirasu hollow microspheres and dinitrosopentamethylenetetramine as a density controlling agent, respectively. When the emulsion explosive compositions were subjected to the temperature cycle test, the explosive compositions maintained their good emulsified state after as large as 30 times of temperature cycles, and were able to be detonated at −20° C. by a No. 6 blasting cap and had detonation velocities of 4,180 m/sec, 3,880 m/sec and 4,210 m/sec, respectively. The reason why the detonation velocity of the explosive composition of Example 1 is higher than that of the explosive composition of Example 3 is probably as follows. The particle size of the glass hollow microspheres used in Example 1 is as small as about one-tenth that of shirasu hollow microspheres used in Example 3, and the number of glass hollow microspheres are larger than that of shirasu hollow microspheres when the amounts of both hollow microspheres contained in respective explosive compositions are same with each other, and hence the explosive composition containing glass hollow microspheres in Example 1 has a larger number of bubbles, which act as hot spots, and has an excellent detonability and a high detonation velocity.

In Examples 5, 6, 7, 8 and 9, W/O emulsion explosive compositions were produced by the use of sodium N-methyl-N-alkyl(beef tallow)-turate, sodium sperm alcohol sulfate, potassium octadecylsulfonate, ammonium dodecylbenzenesulfonate and calcium dodecylbenzenesulfonate as an emulsifier, respectively. The explosive compositions had the same excellent performance as that of explosive composition of Example 3. In Example 10, a smaller amount of a density controlling agent was used, and therefore the density of the resulting W/O emulsion explosive composition was higher. Accordingly, the detonability at low temperature of the explosive composition after temperature cycle test was somewhat inferior to that of the explosive compositions in Examples 1–9.

It can be seen from the above described comparative examples and examples that the W/O emulsion explosive composition of the present invention is superior to conventional W/O emulsion explosive composition in the emulsion stability in storage, detonability at low temperature, explosion reactivity and sympathetic detonability.

What is claimed is:

1. A water-in-oil emulsion explosive composition consisting essentially of (a) ammonium nitrate or a mixture of ammonium nitrate and at least one inorganic oxidizer salt, (b) water, (c) at least one member of the group consisting of oil and wax, (d) at least one emulsifier of the group consisting of potassium octadecylsulfonate and sodium N-methyl-N-alkyl(beef tallow)-taurate, (e) at least one of the group consisting of bubbles generated from a chemical foaming agent and hollow microspheres.

2. The composition of claim 1, wherein said inorganic oxidizer salt is selected from the group consisting of sodium nitrate, calcium nitrate, sodium chlorate and sodium perchlorate.

3. The composition of claim 1, wherein said oil is a hydrocarbon oil and said wax is paraffin wax, petrotalum wax or microcrystalline wax.

4. The composition of claim 3, wherein said hydrocarbon oil is light oil or heavy oil.

5. A water-in-oil emulsion explosive composition as claimed in claim 1, wherein the hollow microsphere is glass hollow microsphere, synthetic resin hollow microsphere, silica hollow microsphere or shirasu hollow microsphere.

6. A water-in-oil emulsion explosive composition as claimed in claim 1, wherein the chemical foaming agent is a mixture of alkali metal borohydride or sodium nitrite with urea, N,N'-dinitrosopentamethylenetetramine, azodicarbonamide or azobisisobutyronirile.

7. A water-in-oil emulsion explosive composition as claimed in claim 1, wherein the amount of ammonium nitrate or the mixture of ammonium nitrate and the other inorganic oxidizer salts is 50–90% by weight, that of water is 5–20% by weight, that of the group consisting of oil and wax is 1–7% by weight, that of the emulsifier is 1–5% by weight, that of the hollow microsphere is 1–10% by weight and that of the chemical foaming agent is 0.1–2% by weight.

* * * * *